United States Patent [19]

Kitchen

[11] 4,195,376

[45] Apr. 1, 1980

[54] BOX SPRING ASSEMBLY WITH IMPROVED END STIFFNESS

[75] Inventor: John P. Kitchen, Georgetown, Ky.

[73] Assignee: Hoover Universal, Inc., Saline, Mich.

[21] Appl. No.: 941,927

[22] Filed: Sep. 13, 1978

[51] Int. Cl.[2] ..... A47C 23/04

[52] U.S. Cl. ..... 5/255; 5/251

[58] Field of Search ..... 5/247–255, 5/259, 260, 351

[56] References Cited

U.S. PATENT DOCUMENTS

| | | | |
|---|---|---|---|
| 3,286,281 | 11/1966 | Slominski | 5/247 |
| 3,574,241 | 4/1971 | Slominski | 5/247 R |
| 3,977,029 | 8/1976 | Hancock | 5/247 |

*Primary Examiner*—Casmir A. Nunberg

*Attorney, Agent, or Firm*—Olsen and Stephenson

[57] ABSTRACT

A spring and frame assembly, particularly for box springs for beds of extended length, consisting of a plurality of main springs arranged criss-cross fashion on a rectangular supporting frame to form a load supporting deck having a regular array of rectangular spaces, and internal support springs mounted on the frame extending diagonally across associated rectangular spaces and secured to the main springs. Each internal support spring has a main body portion and depending end portions which resiliently support the main body portion in spaced relation above the frame. Selected ones of the internal support springs have longer main body portions than the remaining internal support springs and are arranged adjacent the opposite ends of the box spring assembly to provide the ends of the box spring assembly with additional resistance to downward loads.

2 Claims, 3 Drawing Figures

BOX SPRING ASSEMBLY WITH IMPROVED END STIFFNESS

BACKGROUND OF THE INVENTION

A significant improvement in box spring assemblies is disclosed in U.S. Pat. No. 3,286,281, assigned to the assignee of the present invention. Previously, conventional box springs were constructed primarily of coil springs, and as a result of the large number of coil springs used, the box spring assembly tended to be extremely heavy and expensive to assemble. The box spring assembly disclosed in U.S. Pat. No. 3,286,281 consists of a box spring assembly having formed wires which provided the required user comfort and stiffness and which was lighter and required fewer components than its coil box spring counterpart. The demand for longer mattresses and box springs is greater than has previously been experienced. In part, the growing demand for a longer mattress is a result of the increasing average height of the adult population. Increases in cost and labor input in the production of box spring assemblies can be minimized if such longer box spring assemblies are constructed having no more components than has been used in the past. It is especially important that the stiffness of the ends of the box springs assembly be maintained or even increased slightly to support downward loads at those locations. The object of the present invention, therefore, is to provide an improved box spring assembly characterized by increased stiffness at its ends.

SUMMARY OF INVENTION

In accordance with the present invention, a box spring assembly of extended length is provided consisting of the usual rectangular supporting frame which includes side and end rails and transversely extending slats. A plurality of transversely and longitudinally extending main springs are arranged in a criss-cross fashion on the frame to form a load supporting deck on which a mattress is disposed. Each main spring has resilient end portions mounted on the frame supporting a main body portion which consists of an elongated wire extending between the end portions and located in spaced relation above the frame.

Internal support springs are arranged to be connected to adjacent main springs for supporting the main body portions thereof. Each internal support spring includes a main body portion having resilient depending end portions mounted on the frame for supporting its main body portion above the frame. Selected ones of the internal support springs have longer main body portions than the main body portions of the remaining standard internal support springs and are positioned adjacent the ends of the box spring assembly so as to position their depending end portions closer to the outer ends of the box spring assembly. This arrangement increases the load resisting capabilities of the box spring assembly at its ends. The additional stiffness enhances the service life of the box spring assembly as well as providing user comfort at the ends of the box spring assembly.

The distance between each pair of adjacent transversely extending main springs between which a long internal support spring is interposed is greater than the distance between an adjacent pair of transversely extending main springs between which a standard internal support spring is disposed by virtue of the fact that the selected internal support springs have longer main body portions than do the standard internal support springs. However, the distance between adjacent pairs of longitudinally extending main springs is the same, both for adjacent longitudinally extending main springs between which a long internal support spring is interposed and those adjacent longitudinally extending springs between which a standard internal support spring is disposed because the transverse displacement of the end portions is the same, both for the long and for the standard internal support springs.

Further objects, features and advantages of the present invention will become apparent from a consideration of the following description when taken in connection with the appended claims and the accompanying drawing in which:

Figure 1:
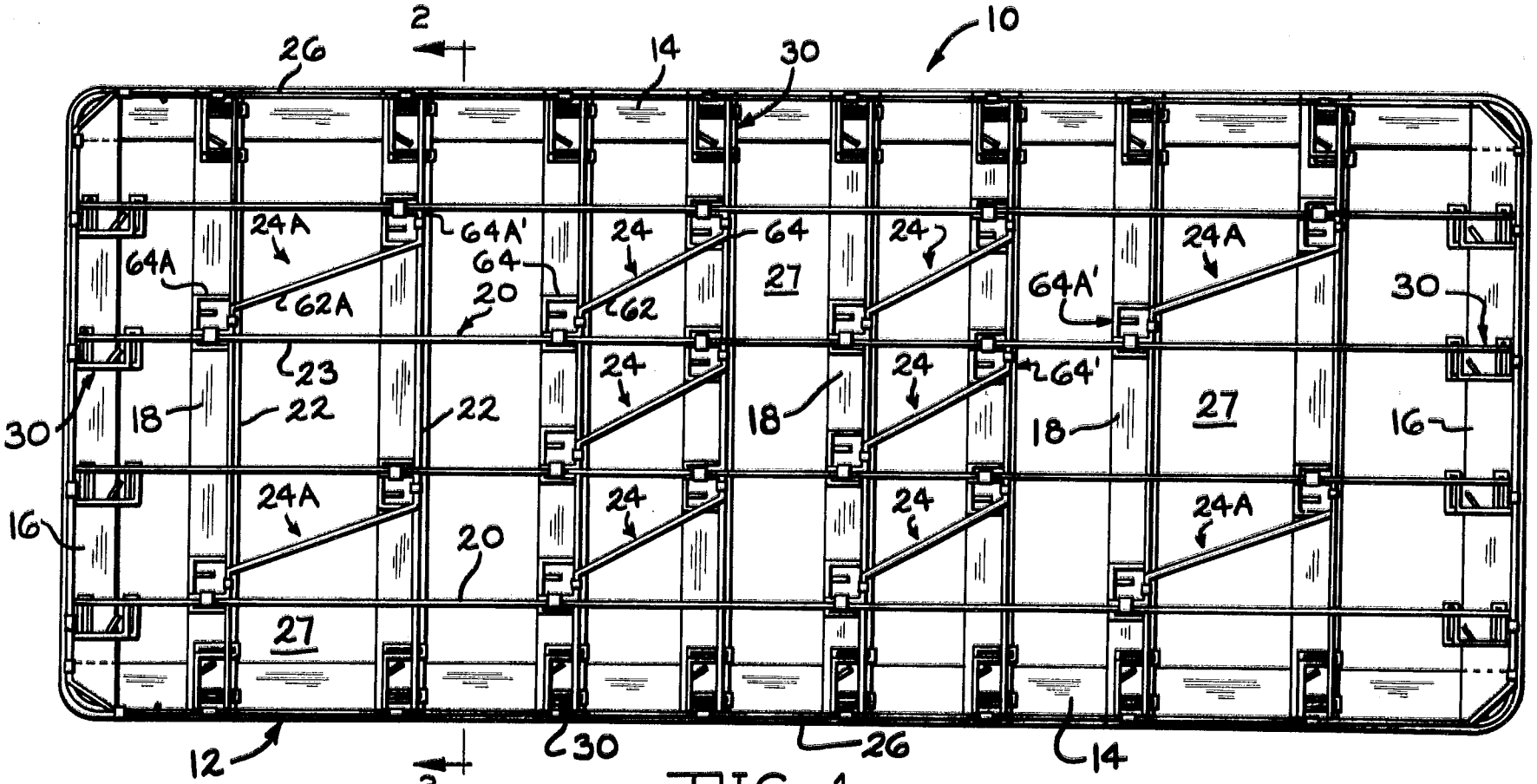
FIG. 1 is a plan view of the box spring assembly of this invention.

With reference to the drawing, the spring and frame assembly of this invention, indicated generally at 10, is shown in FIG. 1 consisting of a rectangular support frame 12 having side rails 14 and end rails 16. Support members or slats 18 extend transversely across the frame 12 and are supported by the end rails 14. The slats 18 are spaced apart in longitudinal directions and are essentially parallel with the end rails 16.

The frame 12 also includes a plurality of longitudinally extending main springs 20 and a plurality of transversely extending main springs 22. The main springs 20 and 22 are arranged in a in a criss-cross fashion on the frame 22 which defines a plurality of rectangular spaces 27. The springs 20 and 22 thus form load supporting deck on which a mattress (not shown) is positioned. A plurality of internal support springs 24 and 24A are mounted on the slats 18 and are connected to the main springs 20 and 22 to provide internal support for the main springs 20 and 22. A sectional border wire 26 is secured to the main springs 20 and 22 so as to be disposed above the side and end rails 14 and 16.

The main springs 20 and 22 are essentially identical, differing only in that the springs 20 are longer than the springs 22. Each main spring 20 and 22 includes an elongated load support or main body portion 28 which is a straight length of wire, and depending end portions 30, which are right and left hand versions of each other, and which extend downwardly from the ends of the main body portion 28. The end portions 30 are mounted on the side rails 14 for the transversely extending main springs 22, and on the end rails 16 for the longitudinally extending main springs 20 and serve to resiliently support the main body portions 28 in spaced relation above the frame 12.

Figure 2:
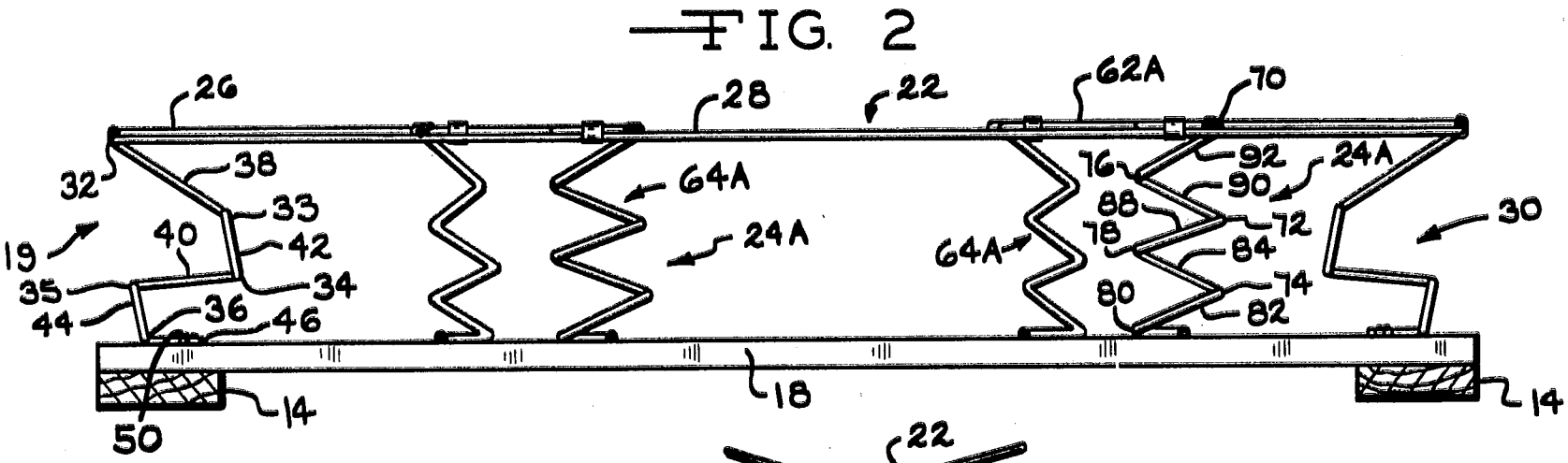
FIG. 2 is a transverse sectional view of the box spring assembly of this invention as seen substantially from the line 2—2 in FIG. 1.

The end portions 30 of the springs 20 and 22 are disclosed in U.S. Pat. No. 3,574,241, issued to the assignee of the present invention, the disclosure of which is incorporated in this disclosure by reference. As seen in FIG. 2, each main spring 20 and 22 includes end portion 30 having five torsion bars 32, 33, 34, 35, and 36, a connecting bar 38 which extends downwardly and inwardly from one end of the torsion bar 32 to one end of the torsion bar 33, shown in FIG. 2, and a connecting bar 40 which extends downwardly and outwardly from one end of the torsion bar 34 to one end of the torsion bar 35. The connecting bars 38 and 40 are disposed in substantially the same vertical plane. The end portion 30 also includes a pair of generally upright spacer bars 42 and 44 which are also disposed in substantially the same vertical plane that is spaced from the plane in which connecting bars 38 and 40 are disposed. The spacer 42 extends between the ends of the torsion bars 33 and 34 and the spacer bar 44 extends between the ends of the torsion bars 35 and 36. A generally L-shape attaching foot 46 forms a lower end of the end portion 30 and is secured to one of the side or end rails 14 or 16 in the usual manner, such as with staples 50. Thus, the depending end portions 30 of the main springs 20 and 22 serve to resiliently support the main body portions 28 above the frame 12.

The internal support springs 24 and 24A are mounted on the slats 18 and each spring 24 and 24A extends generally diagonally across an associated rectangular space 27 formed by intersecting pairs of the main wire springs 20 and 22. The support springs 24 and 24A are essentially identical. Each standard internal support spring 24 has a main body portion 62 and depending end portions 64, the depending end portions 64 being identical except that they are right and left hand versions of each other. The selected internal support springs 24A are identical to the standard internal support springs 24 except that the internal springs 24A have main body portions 62A that are longer than the main body portions 62 of the standard internal support springs 24. The depending end portions 64A of each internal support spring 24A are identical to the depending end portions 64 of the standard internal support spring.

The long internal support springs 24A are positioned adjacent each end of the box spring assembly 10 and serve to increase the load carrying capabilities of the box spring assembly at its ends. The distance between the adjacent pairs of main springs 22 between which long selected internal support spring 24A is disposed is greater than the distance between adjacent pairs of the main springs 22 between which a standard internal support spring 24 is disposed because of the longer main body portion 62A.

Each long internal support spring 24A is constructed so that the transverse distance between its depending end portions 64A is equal to the transverse distance between the depending end portions 64 of the standard support springs 24. Consequently, the distance between adjacent pairs of longitudinally extending main springs 20 is the same when a long internal support spring 24A or a standard internal support spring 24 is interposed between adjacent main springs 20. Thus, as seen in FIG. 1, the internal support springs 24A are positioned in longitudinal alignment with the standard internal support springs 24.

Figure 3:
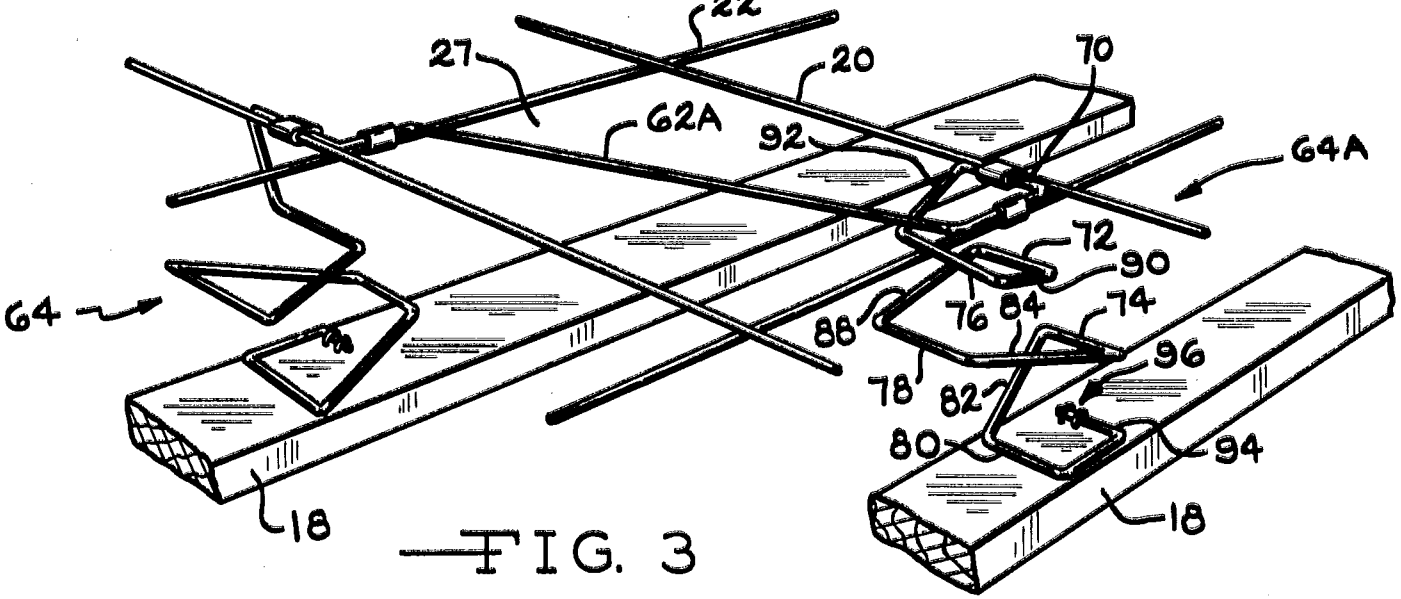
FIG. 3 is a fragmentary perspective view of a portion of the box spring assembly of this invention showing an internal support spring mounted on a pair of slats in the spring and frame assembly of this invention.

The depending end portions 64A of the internal support spring 24A which are identical to the end portions 64 of the standard internal support springs 24 are illustrated in FIGS. 2 and 3. Each depending end portions 64A consists of a torsion bar 70 which is parallel to and spaced above a second torsion bar 72 which in turn is parallel to and spaced above a third torsion bar 74. The torsion bars 70,72, and 74 are located in a common vertical plane. A fourth torsion bar 76 is positioned in a vertical plane that is spaced from the vertical plane occupied by the torsion bars 70, 72, and 74. A fifth torsion bar 78 is located parallel to and directly below the torsion bar 76 and a torsion bar 80 is located directly below the torsion bar 78. The torsion bar 80 is connected at one end to one end of the torsion bar 74 by an upwardly inclined connecting bar 82. The other end of the torsion bar 74 is connected by an upwardly inclined connecting bar 84 to one end of the torsion bar 78 which has its other end connected to the torsion bar 72 by a connecting bar 88. The other end of the torsion bar 72 is connected to the torsion bar 76 by a connecting bar 90. Finally a connecting bar 92 connects the other end of the torsion bar 76 to the torsion bar 70. The connecting bars 82, 88 and 92 are all located in the same vertical plane while the connecting bars 84 and 90 are located in another vertical plane spaced apart from the vertical plane having the connecting bars 82, 88, and 92. An attaching foot 94 is fastened to the slat 18 by staples 96 to mount the spring 24 onto the slat 18.

As seen in FIG. 1, a pair of internal support springs 24A are positioned adjacent each end of the box spring assembly 10 in transverse alignment with each other with an open rectangular space 27 disposed between the adjacent springs 24A. The springs 24A on both ends of the assembly 10 are also in longitudinal alignment with each other with a pair of standard internal support springs 24 disposed between the longitudinally aligned springs 24A.

Since the transverse displacement of the depending end portions 64A of each internal support spring 24A equals the transverse displacement of the depending end portions 64 of the standard internal support springs 24, both the springs 24 and 24A can be longitudinally aligned between adjacent longitudinally-extending main springs 20. The standard internal support springs 24 are located at the central area of the box spring assembly 10 to concentrate the load-supporting end portions 64 in that area where most of the downward forces are present.

Use of the long internal support springs 24A provides a twofold function. First, the inner end portion 64A is located in close proximity to the standard internal support springs 24 to cooperate therewith in supporting loads at the center of the box spring assembly. Second, the outer end portions 64A are located near the ends of the box spring assembly so to increase the load carrying capablilites of the box spring assembly 10 at its ends.

From the above description, it can be seen that an improved box spring assembly 10 is provided having increased end stiffness provided with a minimum number of internal support springs 24 and 24A. Optimum user comfort is still maintained in a box spring assembly that is low in cost and easy to manufacture.

What is claimed:

1. A box spring assembly having front and rear ends and comprising a frame, a plurality of main springs extending transversely of said frame, a plurality of main springs extending longitudinally of said frame, each of said main springs having a main body portion and depending end portions, said end portions being mounted on said frame to resiliently support said main body portion in spaced relation above said frame, said main body portions cooperating to form a load supporting deck having a plurality of rectangular spaces, and internal support springs connected to said main springs between said main spring body portions, each of said internal support springs having a main body portion extending diagonally across one of said rectangular spaces and depending end portions mounted on said frame for resiliently supporting said internal support spring main body portion in general horizontal alignment with said load supporting deck, selected ones of said internal springs having main body portions longer than the main body portions of the remaining ones of said internal support springs, said selected internal support springs being arranged in said spring assembly adjacent said ends to provide added support to said ends of said box spring assembly where they are arranged, the selected internal support springs adjacent each end of said box spring assembly being in transverse alignment, and at least some of the remaining internal support springs being positioned in longitudinal alignment with said selected internal support springs, the depending end portions of said selected internal support springs being displaced transversely of said box spring assembly a distance that is substantially equal to the transverse displacement of the depending end portions of the remaining internal support springs which are in longitudinal alignment therewith whereby said selected and aligned remaining internal support springs extend between and are connected to adjacent pairs of longitudinally extending main springs, each of said selected internal support springs being positioned so that one depending end portion thereof is adjacent to a depending end portion of a longitudinally extending main spring to provide added support at the end of said box spring assembly and the other depending end portion of said selected internal support spring being positioned longitudinally inwardly of said one depending end portion to cooperate with the remaining internal support springs to provide support intermediate the ends of said box spring assembly.

2. The box spring assembly according to claim 1, wherein said transversely extending main springs between which said internal support springs extend are spaced apart a distance substantially equal to the longitudinal distance between the depending end portions of said internal support springs so that the distance between adjacent transversely extending main springs between which said selected internal support springs extend is greater than the distance between adjacent transversely extending main springs between which a remaining internal support spring extends.

* * * * *